United States Patent [19]

Pareja

[11] 4,284,392

[45] Aug. 18, 1981

[54] ROLLER PUMP WITH RADIAL MEMBERS

[75] Inventor: Ramon Pareja, Minneapolis, Minn.

[73] Assignee: Lear Siegler, Inc., Santa Monica, Calif.

[21] Appl. No.: 756,051

[22] Filed: Jan. 3, 1977

[51] Int. Cl.[3] ..... F04C 2/00

[52] U.S. Cl. ..... 418/225; 418/259

[58] Field of Search ..... 418/225, 259, 260, 256, 418/257

[56] References Cited

U.S. PATENT DOCUMENTS

| | | | |
|---|---|---|---|
| 771,593 | 10/1904 | Welsh | 418/259 X |
| 1,580,162 | 4/1926 | Peterson | 418/225 |
| 1,666,466 | 4/1928 | Peters | 418/260 |
| 2,708,884 | 5/1955 | Deschamps | 418/137 X |
| 3,316,852 | 5/1967 | Sadler | 418/225 |
| 3,542,498 | 11/1970 | Sadler | 418/225 |
| 3,785,758 | 1/1974 | Adams et al. | 418/260 |

*Primary Examiner*—Leonard E. Smith

*Attorney, Agent, or Firm*—Orrin M. Haugen; Thomas J. Nikolai

[57] ABSTRACT

A roller pump comprising a generally cylindrical housing and a generally cylindrical rotor disposed eccentrically within the housing, and having push rods arranged radially within the rotor for assisting in forcing radial motion of the rollers within the rotor during rotation of the rotor within the housing. A camming shaft is disposed within the housing, and arranged generally with the housing, the push rods making contact with the periphery of the camming shaft in order to provide radial motion of the push rods during rotation of the rotor. The cross-sectional dimension of the push rods is preferably equal to at least 33⅓ percent of the axial length of the rollers, and secondarily preferably having a diameter generally equal to the roller diameter. The cross-sectional dimension of the push rods at the line of contact with the roller surface enables the pump to effectively handle highly viscous products.

4 Claims, 3 Drawing Figures

ROLLER PUMP WITH RADIAL MEMBERS

BACKGROUND OF THE INVENTION

The present invention relates generally to a roller pump with a conventional generally cylindrical housing, and an eccentrically arranged cylindrical rotor mounted for rotation within the housing. The rotor is provided with arcuately spaced slots for accommodating the rollers therewithin, and in addition the structure is provided with push rods for applying a force against the individual rollers so as to move the rollers outwardly during the rotation of the rotor.

Roller pumps have been widely utilized in the past, and are described typically in a number of United States Letters Patent, such as, for example U.S. Pat. Nos. 3,542,498, 3,477,377 and 3,402,672. Typically, roller pumps are provided with a generally cylindrical housing which is provided with a cylindrical bore therewithin for accommodating a cylindrical rotor. The rotor is typically mounted for rotation eccentrically with the axis of the housing. The housing is further provided with an inlet port and an outlet port each of which communicates with the chamber formed within the housing, and, of course, accommodates the passage of fluid being pumped therethrough. Such roller pumps have a wide variety of applications, with these pumps being highly suited for pumping of fluids containing suspended solids such as wettable powders and the like.

SUMMARY OF THE INVENTION

In accordance with the present invention, push rods are arranged within the body of the rotor for applying a radial force to the rollers, thereby assisting in movement of the rollers within the roller receiving slots. The push rods are provided with a surface making line contact with the rollers, and the length of the line contact is sufficiently long so as to avoid canting or non-aligned motion of the roller during rotation.

Generally speaking, the length of the line contact between the push rod and the roller is approximately $\frac{1}{3}$ of the axial length of the roller, thus assisting in the providing of stable radial motion of the roller within the roller receiving slot. Again, typically, the depth of the roller receiving slot is at least equal to the roller diameter, although in some structures, the depth of the roller receiving slots substantially exceeds the roller diameter. The utilization of push rods in accordance with the present invention is applicable to both conventional and deep-slotted rotors.

In order to achieve the radial motion or stroking of the push rods, a camming shaft is provided which is disposed concentric with the axis of the cylindrical housing. Thus, upon rotation of the rotor about its parallelly disposed and spaced axis, the individual push rods, which are in running contact with the surface of the camming shaft, are forced radially outwardly in response to the relative positions of the rotor relative to the camming shaft. The provision of such push rods and cam shaft combination enables the roller pump to effectively handle highly viscous fluids, including such fluids as molasses, viscous oils, and the like.

Therefore, in accordance with the present invention, an improved roller pump is provided which utilizes a plurality of push rods for stroking the roller radially outwardly, thereby enhancing the adaptability of the roller pump for use with highly viscous fluids.

It is a further object of the present invention to provide an improved roller pump utilizing a generally cylindrical housing and having a rotor mounted upon an axis parallelly disposed and spaced from the axis of the housing, and wherein a camming shaft and push rod arrangement is provided for forceably urging the individual rollers radially outwardly within the individual roller receiving slots as the rotor rotates within the housing.

It is yet a further object of the present invention to provide an improved roller pump structure which utilizes means for applying a force urging the roller outwardly of the roller receiving slot, and wherein the means applying the force to the roller utilizes a contacting surface which is sufficiently long so as to eliminate canting or non-parallel motion of the roller within the roller receiving slot.

Other and further objects of the present invention will become apparent to those skilled in the art upon a study of the following specification, appended claims and accompanying drawing.

DESCRIPTION OF THE PREFERRED EMBODIMENT

Figure 1:
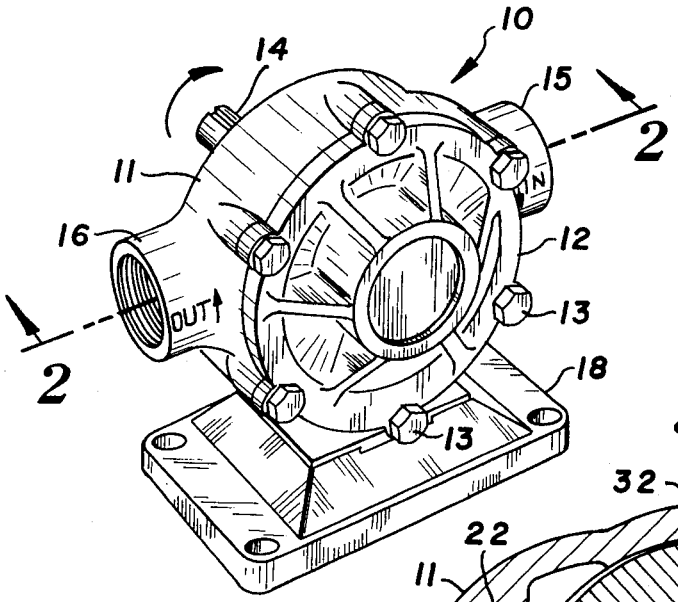
FIG. 1 is a perspective view of a roller pump prepared in accordance with the present invention, and illustrating one end of the housing, together with the disposition of the inlet and outlet ports.

In accordance with the preferred embodiment of the present invention, and with particular attention being directed to FIG. 1 of the drawing, the roller pump structure generally designated 10 includes a metallic casting forming a housing 11 with a cover plate 12 secured thereto by a plurality of cap screws as at 13—13. A crank shaft is provided at 14, which is secured fast to the rotor, and is, of course, utilized to provide rotational motion for the rotor as will be more fully discussed hereinafter. An inlet port is provided at 15, with an outlet port being shown at 16, with both ports being internally threaded so as to receive conduits in threaded engagement therewithin. A mounting plate or base is provided at 18, for appropriately and conveniently mounting the structure upon a suitable support pad, not shown.

Figure 2:
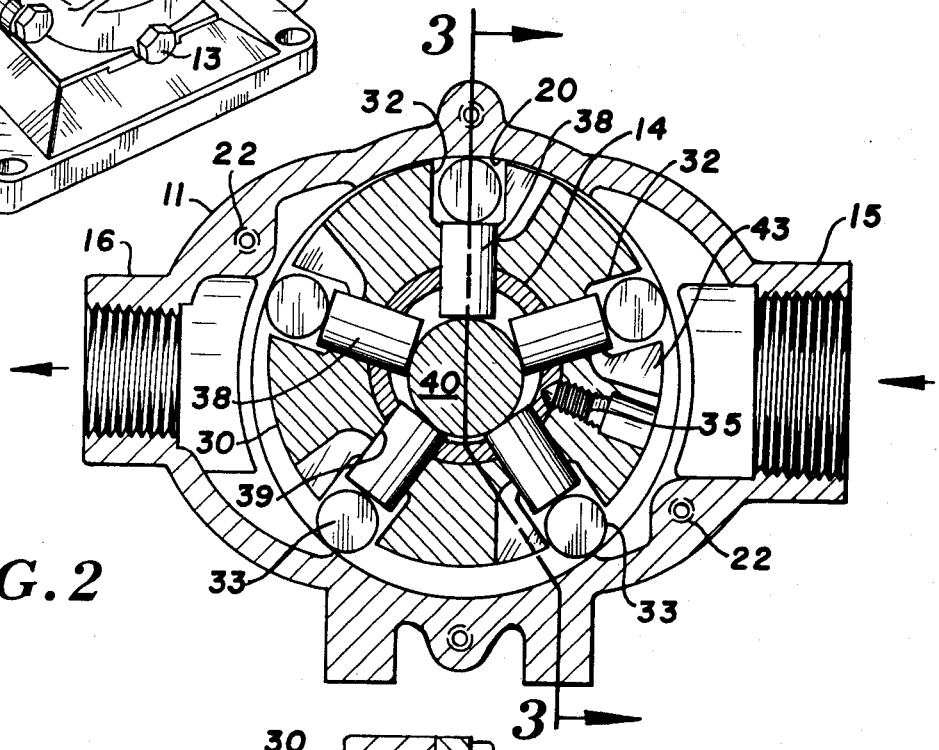
FIG. 2 is a vertical sectional view taken along the line and in the direction of the arrows 2—2 of FIG. 1, and illustrating the pump body with the base or mounting plate removed therefrom.
Figure 3:
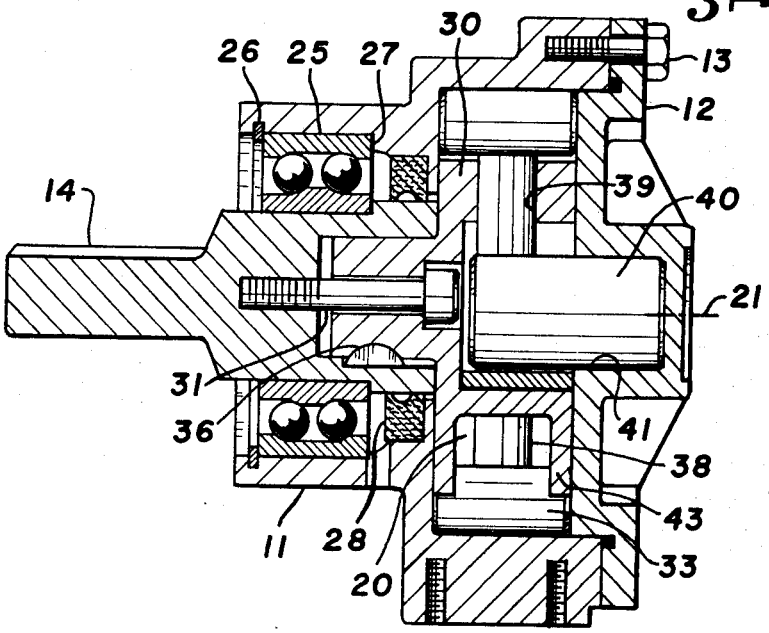
FIG. 3 is a vertical sectional view taken along the line and in the direction of the arrows 3—3 of FIG. 2.

With attention now being directed to FIG. 2, it is seen that the casting 11 is provided with a generally cylindrical bore or opening therewithin, such as is illustrated at 20, thus providing and forming a generally cylindrical housing. The housing has a central axis, as illustrated in FIG. 3, as at 21. Threaded bores are formed in housing 11 as at 22—22 for the receipt of the cap screws 13—13 as shown in FIG. 1.

With continued attention being directed to FIG. 2, but with attention also being directed to FIG. 3, it will be seen that crank shaft 14 is journaled for rotation within casting or housing 11, with ball bearings 25 being utilized for journaling crank shaft 14 within casting 11. A snap ring as at 26 retains the bearing 25 in proper disposition against step 27. Seal 28 prevents flow of pump fluid from the chamber 20 outwardly to the bearing area. Rotor 30 is shown in FIGS. 2 and 3, with rotor 30 being secured to crank shaft 14 by means of screw member 31. As is apparent in FIG. 2, a plurality of roller receiving slots are provided at 32—32, with each of the slots having a roller such as the rollers 33—33 disposed therewithin. In order to assist in fastening rotor 30 to crank shaft 14, and for locking rotor 14 so that simultaneous rotation of rotor 30 and shaft 14 will occur, set screw 35 is provided, with set screw 35 threadly engaging a bore formed in rotor 30, and further gripping or otherwise engaging the exterior surface of crank shaft 14. As an alternate to set screw 35, a key and keyway combination may be utilized as shown in FIG. 3 at 36.

In order to provide for the application of force to the rollers 33—33 in a radially outwardly extending direction, push rods such as push rods 38—38 are provided, with one such push rod being provided for each of the individual rollers 33—33. Push rods 38—38 are disposed within bores, such as bore 39, and with the inner end of push rods 38—38 being maintained on the outer circumferential surface of camming shaft 40. Camming shaft 40 is retained within bore 41 formed in cover plate 12, and is normally press fit into place. As is apparent, camming shaft 40 is disposed concentrically with the central axis of the housing formed in casting 11.

Preferably, the rollers 33—33 may be fabricated from any suitable material, including, for example, nylon, molded polytetrafluoroethylene (Telfon), or metallic materials either per se, or coated with a layer of nylon or polytetrafluoroethylene. Such rollers are, of course, well known in the art and are useful in connection with the structures of the present invention. As is apparent in the drawing, push rod receiving bores 39—39 extend radially outwardly from the rotor axis. Also, in order to assist and guide rollers 33—33 within the individual roller receiving slots 32, side webs are provided as at 43 in order to assist in the control of motion of rollers 33—33. It will be appreciated that other roller receiving slot configurations may be utilized, although the side webs 43 are a conventionally employed feature in rotors of roller pumps.

As has been indicated, the push rods preferably have a diameter generally equal to about $33\frac{1}{3}$ percent of the axial length of the rollers. It will be appreciated, of course, that larger diameter push rods may be employed, with push rods having a cross-sectional diameter or dimension equal to $\frac{1}{2}$ the axial length of the roller being deemed appropriate. In some applications, a larger ratio may also be employed.

As has been indicated, the rollers may be fabricated from synthetic materials such as nylon or polytetrafluoroethylene. Moldable polytetrafluoroethylene is available under the Trademark "TEFLON" from E. I. DuPont de Nemours & Company of Wilmington, Delaware. In order to assist in matching the hardness of the roller to that of the push rod, it is, of course, desirable that both rollers and push rods be fabricated from the same material, or, if coated materials are used for the rollers, that the push rods be fabricated from the material used for coating of the rollers. For most applications, however, it has been found that both push rods and rollers may be fabricated from polytetrafluoroethylene.

I claim:

1. A roller pump comprising:

(a) a housing having longitudinally spaced end walls and an intermediate circumferential wall forming a generally cylindrical pumping chamber;

(b) a rotor rotatably mounted within said pumping chamber with its axis offset from that of the cylindrical pumping chamber;

(c) said rotor having a plurality of roller receiving slots formed into and across the circumferential surface thereof and uniformly angularly spaced therearound, a central concentric bore extending inwardly from a first lateral surface thereof, and a plurality of radially extending bores beginning at said central concentric bore and terminating at the bottom of said roller receiving slots;

(d) a cylindrical cam shaft secured to one of said end walls and extending into said central concentric bore in said rotor;

(e) a cylindrical roller disposed in each roller receiving slot and having a length corresponding to the length of said roller receiving slot;

(f) a push rod disposed in each of said radially extending bores and having a length such that the sum of the radius of said cam shaft, the length of said push rod and the diameter of said cylindrical roller is substantially equal to the radius of said generally cylindrical pumping chamber, said push rods engaging said cylindrical rollers along a line of contact; and (g) fluid inlet and outlet ports formed in said housing and communicating with said cylindrical pumping chamber and effectively separated from one another at a point determined by the offset between said rotor and said cylindrical pumping chamber, the arrangement being such that as the rotor is turned, the axes of said cylindrical rollers are held parallel to the axis of said cylindrical pumping chamber, the surface of said cylindrical rollers being held in positive engagement with the walls of said cylindrical pumping chamber such that viscous fluids may be handled by said pump.

2. Apparatus as in claim 1 wherein the center lines of said radially extending bores are approximately midway between the sides of said rotor and wherein the end of said push rod contacts said cylindrical roller along a line the length of which is in the range of from $\frac{1}{3}$ to $\frac{1}{2}$ of the length of said cylindrical roller.

3. Apparatus as in claim 1 wherein said rotor comprises:

(a) a cylindrical drive shaft having an inwardly extending recess formed on one end of said cylindrical shaft;

(b) a cylindrical plate having a projection on one face thereof generally conforming in shape to the shape of said inwardly extending recess formed on said shaft; and (c) means securing said shaft to said cylindrical plate with said projection contained within said recess.

4. Apparatus as in claim 3 and further including a fluid sealing element disposed between said housing and said cylindrical drive shaft.

* * * * *